US008199065B2

(12) United States Patent
Shachar et al.

(10) Patent No.: US 8,199,065 B2
(45) Date of Patent: Jun. 12, 2012

(54) H-J ANTENNA

(75) Inventors: Aviv Shachar, Ramat-Gan (IL); Yiu K. Chan, Vernon Hills, IL (US); Motti Elkobi, Natanya (IL)

(73) Assignee: Motorola Solutions, Inc., Schaumburg, IL (US)

( * ) Notice: Subject to any disclaimer, the term of this patent is extended or adjusted under 35 U.S.C. 154(b) by 1196 days.

(21) Appl. No.: 11/965,780

(22) Filed: Dec. 28, 2007

(65) Prior Publication Data

US 2011/0181485 A1 Jul. 28, 2011

(51) Int. Cl.
*H01Q 21/30* (2006.01)

(52) U.S. Cl. ..... 343/848; 343/893; 343/702

(58) Field of Classification Search ..... 343/702, 343/700 MS, 848, 893
See application file for complete search history.

(56) References Cited

U.S. PATENT DOCUMENTS

| | | | | |
|---|---|---|---|---|
| 6,911,944 | B2 * | 6/2005 | Sekine et al. | 343/702 |
| 7,119,748 | B2 * | 10/2006 | Autti | 343/702 |
| 7,696,932 | B2 * | 4/2010 | Desclos et al. | 343/702 |
| 2005/0057407 | A1 | 3/2005 | Imaizumi | |
| 2007/0030198 | A1 | 2/2007 | Wei | |
| 2008/0136727 | A1 * | 6/2008 | Bit-Babik et al. | 343/848 |

FOREIGN PATENT DOCUMENTS

| | | |
|---|---|---|
| EP | 1079463 A | 2/2001 |
| EP | 1193797 A | 4/2002 |
| EP | 1530258 A | 5/2005 |

* cited by examiner

*Primary Examiner* — Jacob Y Choi

*Assistant Examiner* — Amal Patel

(74) *Attorney, Agent, or Firm* — Jeffrey K. Jacobs; Anthony P. Curtis; Daniel R. Bestor

(57) ABSTRACT

A dual-band antenna includes a first antenna element having a generally "J" shaped element, and a second antenna element having a generally "h" shaped element. The first antenna element and the second antenna element share a common feed point and each antenna element is oriented substantially perpendicular to the other. The first antenna element and the second antenna element, in one implementation, are adapted to efficiently operate the dual-band antenna at approximately 1575 MHz and approximately 850 MHz, respectively.

11 Claims, 12 Drawing Sheets

Strip (4, 5, 6, 7) iDen band (806-941MHz)

$$f_{0,iDen} = \frac{806 + 941}{2} = 873.5 \text{ MHz}$$

$$\lambda_{0,iDen} = 343.64 \text{ mm}$$

Dimensions:
Strip 4-5: 27mm or 0.078 $\lambda_{0,iDen}$
W4, 5: 2.4mm or 0.007 $\lambda_{0,iDen}$
Strip 5-6: 35mm or 0.1 $\lambda_{0,iDen}$
W5, 6: 5mm or 0.0145 $\lambda_{0,iDen}$
Strip 6-7: 21mm 0.061 $\lambda_{0,iDen}$
W6, 7: 5mm or 0.0145 $\lambda_{0,iDen}$ BENCH STRIP (3, 4, 2, 1) SHARED iDen & GPS BAND TOGETHER $$f0,\ GPS_\&_iDen = \frac{f0,\ GPS + f0,\ iDen}{2} = \frac{1575.42 + 873.5}{2} = 1224.46MHz$$

$\lambda 0,\ GPS_\&_iDen = 225mm$

DIMENSIONS:

STRIP 1-2: 12mm OR $0.05\lambda_{0,\ GPS_\&_iDen}$

STRIP 3-4: 12mm OR $0.05\lambda_{0,\ GPS_\&_iDen}$ $W_{1,\ 2} = W_{3,\ 4}$ 3mm OR $0.0133\lambda_{0,\ GPS_\&_iDen}$ STRIP 2-4: 25mm OR $0.111\lambda_{0,\ GPS_\&_iDen}$

EFFICIENCY iDen (850MHz)

1204

| | | |
|---|---|---|
| Avg. Efficiency (3D) | 68.84998 | % |
| Avg. Gain (3D) | -1.62096 | dBi |

FIG. 12B

GPS (1575MHz)

Full sphere

1206

| | | |
|---|---|---|
| Avg. Efficiency (3D) | 80.69908 | % |
| Avg. Gain (3D) | -0.93131 | dBi |

FIG. 12C

Half sphere (GPS req.)

1208

| | | |
|---|---|---|
| Avg. Efficiency (3D) | 74.27473 | % |
| Avg. Gain (3D) | -1.29159 | dBi |

FIG. 12D

H-J ANTENNA

FIELD OF THE INVENTION

This invention relates in general to dual band antennas, and more particularly, to a dual band H-J antenna for use in hand-held devices.

BACKGROUND OF THE INVENTION

Wireless communication is the transfer of information over a distance without the use of electrical conductors or "wires". This transfer is actually the communication of electromagnetic waves between a transmitting entity and remote receiving entity. The communication distance can be anywhere from a few inches to thousands of miles.

While once relegated to large-scale applications, such as television and radio broadcasts, wireless communication is now an inescapable aspect of virtually every aspect of life. For instance, automobiles have wireless door openers, wireless alarm activators, wireless location devices, e.g. LoJack (a trademark of the LoJack Corporation of Westwood, Massachusetts), and wireless services, e.g. OnStar (a trademark of the General Motors Corporation of Detroit, Michigan). Of course cellular phones operate wirelessly, but in addition, almost all land-line telephones are now sold with wireless handsets. Wireless communication is utilized in a myriad of other applications. One example is a wireless scanning device, used for applications such as keeping tack of delivered packages or conducting inventory counts, that wirelessly communicates scanned and other information back to a main processing station.

Wireless communication is made possible by antennas that radiate and receive the electromagnetic waves to and from the air, respectively. The function of the antenna is to "match" the impedance of the propagating medium, which is usually air or free space, to the source that supplies the signals sent or interprets the signals received. Antenna designers are constantly balancing antenna size against antenna performance. These two characteristics are generally inversely proportional. To overcome the performance losses associated with fitting antennas in smaller footprints, designers have found ways to make the antennas electrically appear taller than they are physically. A few examples of these designs are inverted "F" antennas, planar inverted "F" antennas, inverted "L" antennas, "H" antennas, "J" antennas, and others. The letters used to identify these designs describe, in a general way, the actual shape of the elements used to radiate and receive the signals. These elements are often fabricated in the prior art as slot antennas, which requires a specific conductive antenna structure with gaps between the conductive areas. In applications with little space, providing these gaps is inefficient.

Often, wireless devices have a need for communication in multiple frequency bands. To maximize efficiency, a separate antenna, each tuned for its respective frequency band, is provided in a wireless device. One common issue with dual-band antennas is "isolation" between the antennas. Isolation describes the effect one antenna has on an adjacent antenna. Antennas located in close proximity often require expensive and space-consuming filters to provide adequate isolation.

Therefore, a need exists to overcome the problems with the prior art as discussed above.

SUMMARY OF THE INVENTION

According to one embodiment of the present invention, a dual-band antenna comprises a first antenna element having a generally "J" shaped element, and a second antenna element having a generally "h" shaped element, the first antenna element and the second antenna element sharing a common feed point and each oriented substantially perpendicular to the other.

In one embodiment, the first antenna element and the second antenna element are adapted to efficiently operate the antenna at approximately 1575 MHz and approximately 850 MHz, respectively. The 1575 MHz frequency range is suitable for GPS wireless communications and the 850 MHz frequency range is suitable for iDEN wireless communications.

BRIEF DESCRIPTION OF THE DRAWINGS

The accompanying figures where like reference numerals refer to identical or functionally similar elements throughout the separate views, and which together with the detailed description below are incorporated in and form part of the specification, serve to further illustrate various embodiments and to explain various principles and advantages all in accordance with the present invention.

DETAILED DESCRIPTION

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The present invention provides a novel and efficient dual-band antenna structure that includes an H-shaped element approximately perpendicular to a J-shaped element. The elements share a common feeding point and a common grounding point. The invention is advantageous in that it allows for a reduction of the area normally needed for an antenna environment, without interfering with RF performance.

An antenna comprises a transducer designed to transmit or receive radio waves which are a class of electromagnetic waves. In other words, antennas convert radio frequency electrical currents into electromagnetic waves and vice versa. Antennas are used in systems such as radio and television broadcasting, point-to-point radio communication, wireless LAN, radar, and space exploration.

Physically, an antenna is a conductor that generates a radiating electromagnetic field in response to an applied alternating voltage and the associated alternating electric current. Alternatively, an antenna can be placed in an electromagnetic field so that the field will induce an alternating current in the antenna and a voltage between its terminals.

Figure 1:
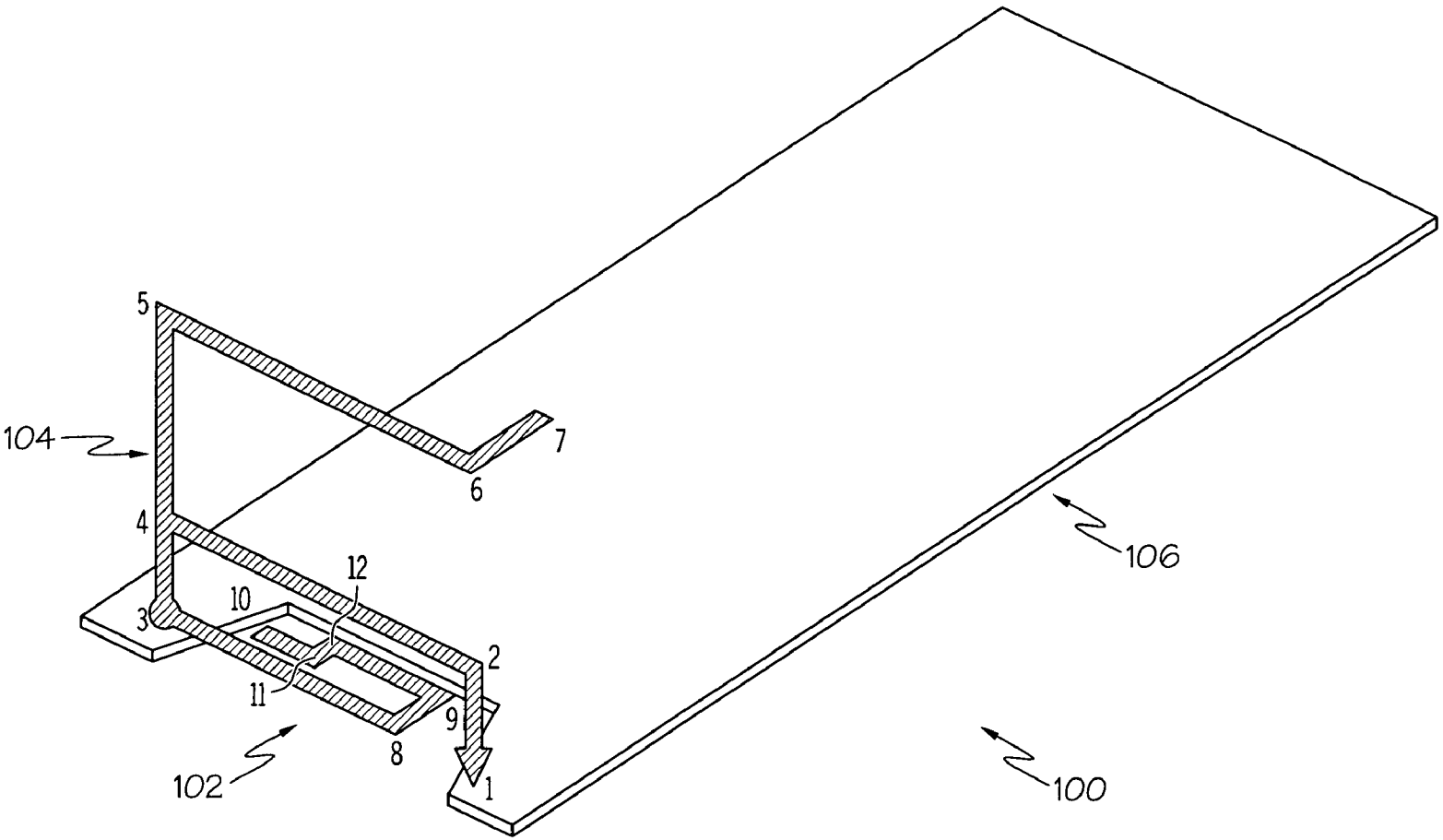
FIG. 1 is an elevated perspective view of a dual-element/dual-frequency band antenna, according to an embodiment of the present invention.

FIG. 1 shows a first embodiment of an antenna in accordance with the present invention. The antenna 100 includes a first element 102 and a second element 104. Each of the elements 102 and 104 are divided into segments that are identified by using points on the antenna numbered 1-12 for ease of discussion. The elements 102 and 104 are positioned on top of a ground plane 106, which is also an integral part of the antenna 100.

Figure 2:
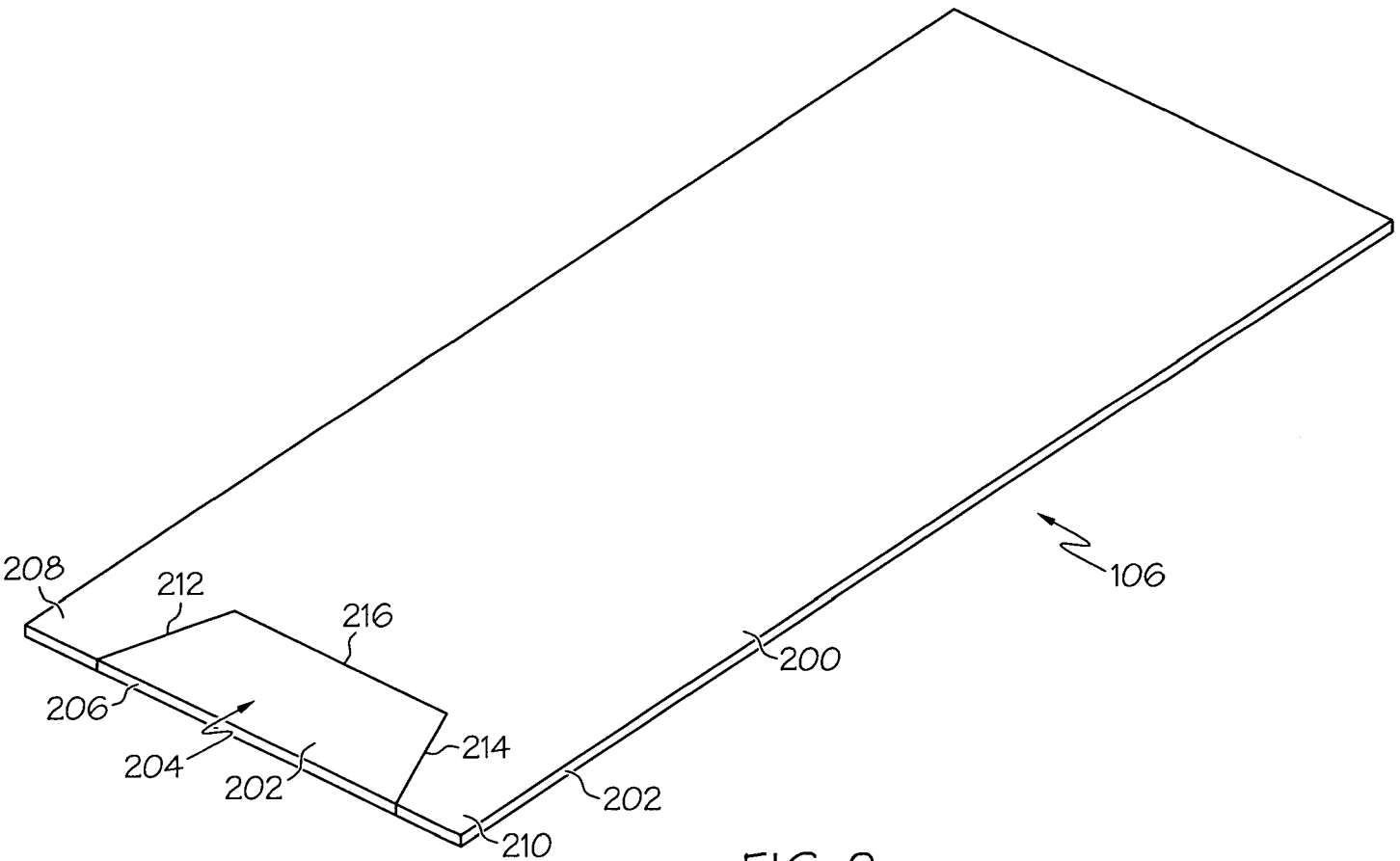
FIG. 2 is an elevated perspective view of the ground plane of the dual-element/dual-frequency band antenna of FIG. 1, according to an embodiment of the present invention.

Ground planes are used to make antenna elements electrically appear larger than they are physically. FIG. 2 shows an elevational view of ground plane 106, which is a large (in comparison to the elements) surface of conducting material 200. When an electromagnetic wave arrives at the surface 200 of the ground plane 106, the incident wave is reflected, whereby the reflected wave has almost the same amplitude as the incident one. Ground planes allow monopole antennas to mirror the performance of dipole antennas.

The conductive surface 200 of the ground plane 106 is placed on top of a supporting non-conductive substrate material 202. As can also be seen in FIG. 2, a section of the conductive material 200 is removed at one end of the ground plane 106 so as to form a channel 204. The channel 204 tapers out as it moves toward an end 206 of the ground plane 106. The removed conductive material 200 creates a first leg 208 and a second leg 210 of the conductive material 200. The channel 204 is formed between the legs 208 and 210 so that the first leg 208 and the second leg 210 are only electrically connected to each other at one end of the legs. Opposing inside edges 212 and 214 of the legs 208 and 210, respectively, and an edge 216 of the conductive material 200, define the shape of the non-conductive channel 204 on the substrate 202 ground plane 106.

Figure 3:
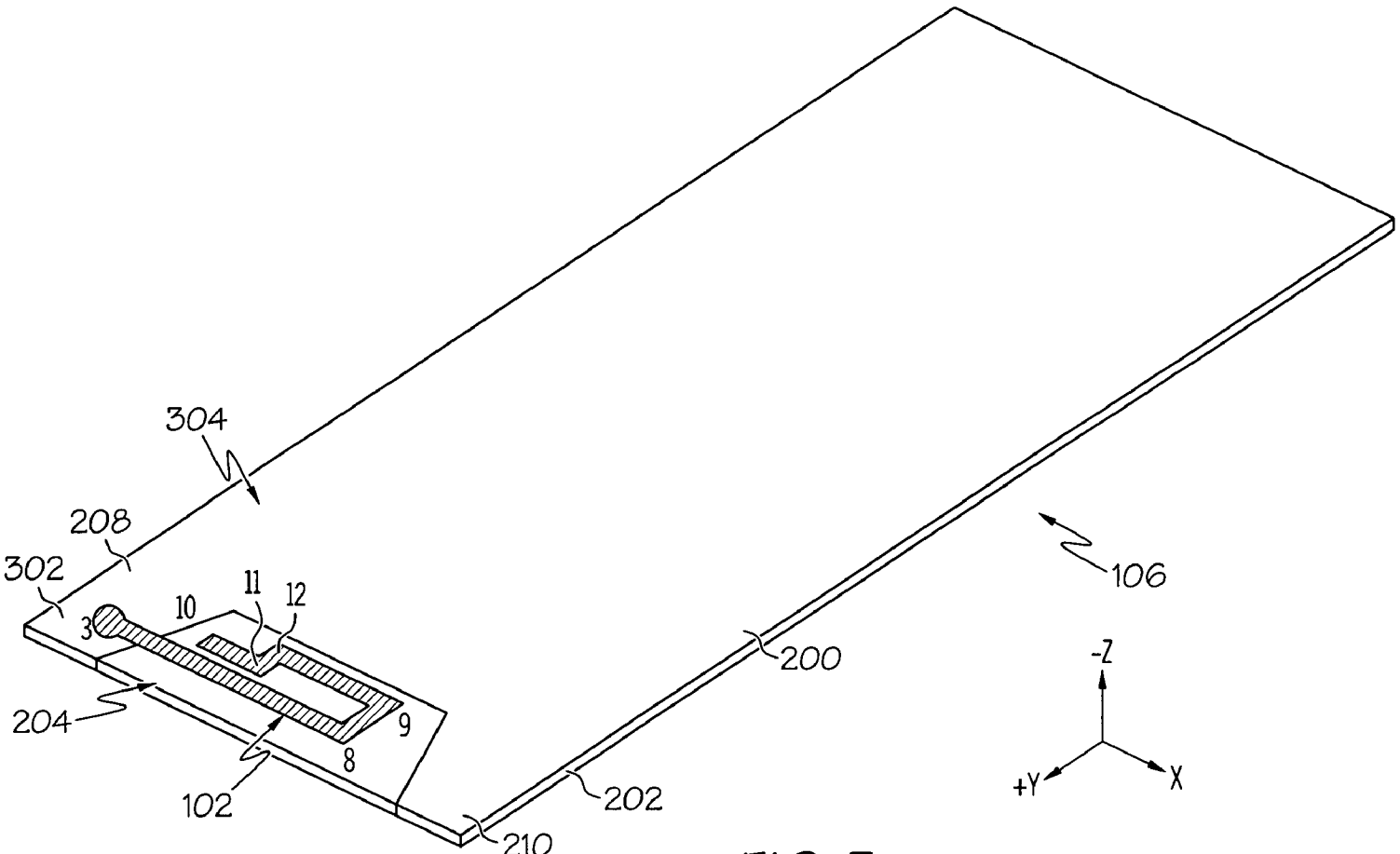
FIG. 3 is an elevated perspective view of the ground plane and GPS antenna element of the dual-element/dual-frequency band antenna of FIG. 1, according to an embodiment of the present invention.

FIG. 3 shows an elevational perspective view of the first antenna element 102 placed on top of the substrate area 204 of the ground plane 106. The first antenna element 102, according to one embodiment of the present invention, is made of a length of stripline conductive material. Construction of antenna elements using stripline conductive material is well-know to those of ordinary skill in the art. The first antenna element 102 is formed generally in a "J" shape, which, in the view shown in FIG. 3, appears as a reverse "J". Stripline material typically is a thin layer of conductive material placed on top of a substrate 202. The width of the stripline is selected based on desired current densities along the path of the line. In one embodiment, the first element 102 is tuned for GPS communication at a frequency range about 1575.42 MHz.

According to one embodiment of the present invention, the first antenna element 102 is divided into a plurality of sections 3-8, 8-9, 9-12, 12-11, and 11-10. A first section 3-8, as shown in FIG. 3, spans from a feed point 3 located at or near a distal end 302 of the first leg 208 of the ground plane 106 to a second point 8 located within the channel 204. The term "distal end," as used herein is intended to indicate any area of a leg 208, 210 that is adjacent to the channel area 204 and is at the midpoint or closer to the end 206 (see also FIG. 2) of the board than to the main part 304 that connects the first 208 and second 210 legs that sandwich the channel 204. The first element 102 also has a second section 8-9 directly electrically connected to an end point 8 of the first section 3-8 and spanning to a point 9, also located within the channel 204. The second section 8-9 is oriented substantially perpendicular to the first section 3-8 and extends in a direction toward the main part 304 of the ground plane 106.

The first element 102 further includes a third section 9-12 that is directly electrically connected from an end point 9 of the second section 8-9 to a point 12 located within the channel 204. The third section 9-12 is oriented substantially parallel to the first section 3-8 and extends in a direction toward the first leg 208 of the ground plane 106.

As can be seen in FIG. 3, the first element 102 further includes a fourth section 12-11 that is directly electrically connected from an end point 12 of the third section 9-12 to a point 11 located within the channel 204. The fourth section 12-11 is oriented substantially parallel to the second section 8-9 and extends in a direction away from the main part 304 of the ground plane 106.

Lastly, as can be seen in FIG. 3, the first element 102 further includes a fifth section 11-10 that is directly electrically connected from an end point 11 of the fourth section 12-11 to a point 10 located within the channel 204. The fifth section 11-10 is oriented substantially parallel to the first section 3-8, at a point along its length moves closer to the first section 3-8, and also it generally extends in a direction toward the first leg 208 of the ground plane 106.

The exact dimensions of any section of the first element 102 depend on the frequencies utilized and the environment in which the antenna is placed. An example of an antenna with sample dimensions will be discussed in more detail below.

In one embodiment of the present invention, all sections 3-8, 8-9, 9-12, 12-11, and 11-10, of the first antenna element 102 are oriented substantially coplanar with the conductive surface 200 of the ground plane 106. The second section 8-9, the third section 9-12, the fourth section 12-11, and the fifth section 11-10, of the first antenna element 102 are generally contained within the non-conductive channel 204 in the ground plane 106. With the exception of the part of the first section 3-8 that makes contact with the feed point 3, the first section 3-8 is also mostly contained within the non-conductive channel 204 in the ground plane 106.

Antenna performance can be described in terms of its radiation pattern. A radiation pattern is typically a multi-dimensional description of the relative field strength transmitted from or received by the antenna. As antennas radiate in space often several curves are necessary to describe the antenna. The radiation pattern of an antenna can be defined as the locus of all points where the emitted power per unit surface is the same. The radiated power per unit surface is proportional to the squared electrical field of the electromagnetic wave. The radiation pattern is the locus of points with the same electrical field.

FIG. 3 shows a reference X, Y, Z axis. The radiation pattern of the first element can generally be thought of as traveling along the Z axis, with its lowest radiating and receiving power, its null, being along the Y, X plane, which is along the plane of the conductive ground plane 106.

Figure 4:
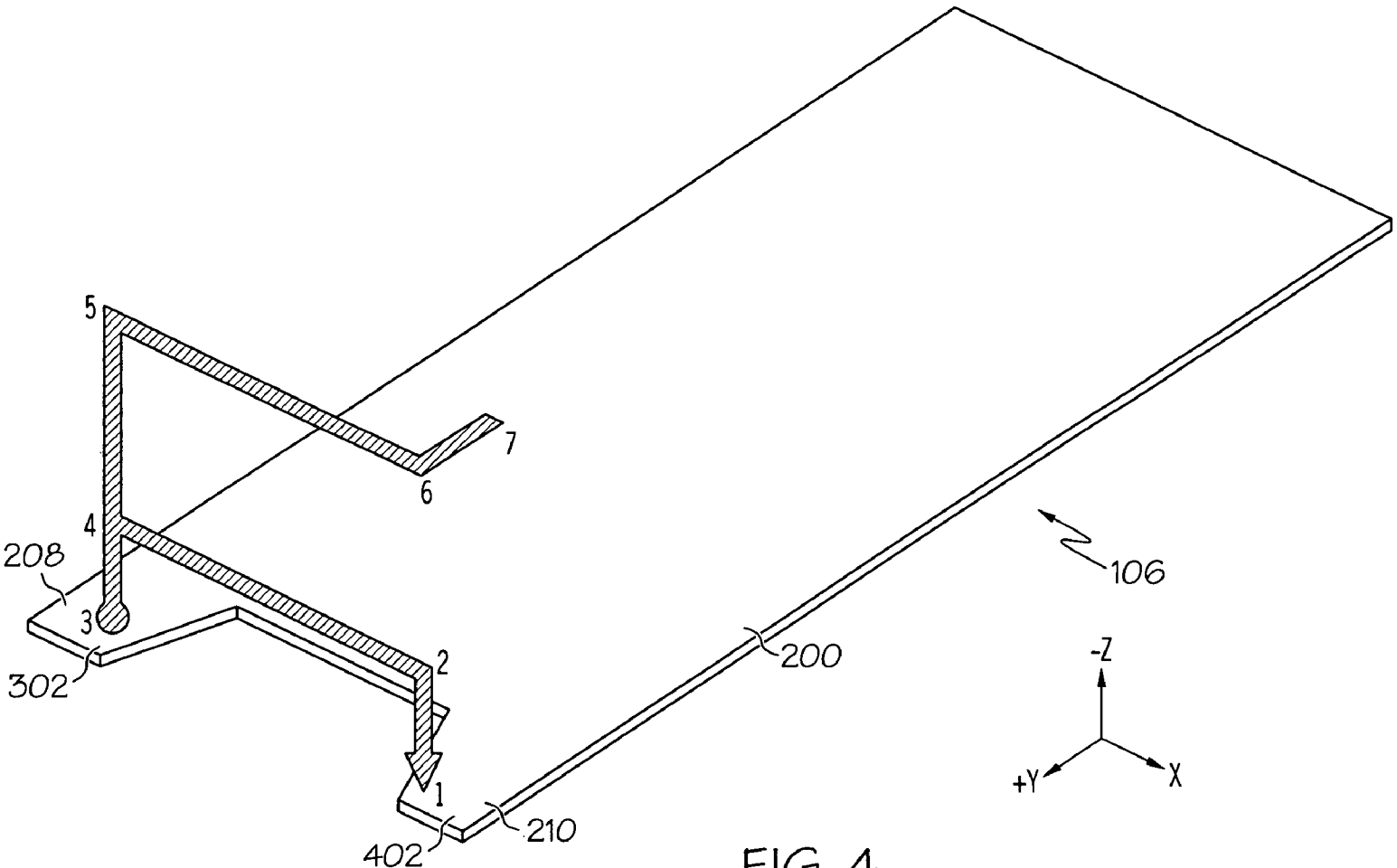
FIG. 4 is an elevated perspective view of the ground plane and iDen antenna element of the dual-element/dual-frequency band antenna of FIG. 1, according to an embodiment of the present invention.

As is shown in FIG. 4, the present invention also includes a second antenna element 104 that has a general "h" shape. The "h" shape is generally defined by the points 3, 4, 5, 2, and 1. The second antenna element 104 is oriented substantially perpendicular to the conductive surface 200 of the ground plane 106. Accordingly, the first antenna element 102 and the second antenna element 104 are oriented substantially perpendicular to each other. Both of the elements share a common feed point 3.

The second element 104 is comprised of five sections. A first section 3-5 extends from the distal end 302 of the first leg 208 of the ground plane 106 in a direction substantially perpendicular to the conductive surface 200 of the ground plane 106. A second section 4-2 branches off of the first section 3-5 at a point 4 generally in the middle portion of the first section 3-5 and in an orientation substantially parallel to the conductive surface 200 of the ground plane and in a direction toward the second leg 210. A third section 2-1, oriented substantially parallel with the first section 3-5, has a first end in direct electrical contact with an end point 2 of the second section 4-2. The third section 2-1 also has a second end at a point 1 that is in direct electrical contact with a distal end 402 of the second leg 210 of the ground plane 106. Point 1 is an RF short to ground 200.

The second element 104 also has a fourth section 5-6 that branches from an end point 5 of the first section 3-5 in a direction toward the second leg 210 of the ground plane 106 and in an orientation substantially parallel to the second section 4-2 of the second antenna element 104. In one embodiment of the present invention, the first section 3-5, the second section 4-2, the third section 2-1, and the fourth section 5-6, of the second antenna element 104 are substantially coplanar with each other.

The second antenna element 104 further includes a fifth section 6-7 that branches from an end point 6 of the fourth section 5-6. In one embodiment, the fifth section 6-7 is oriented substantially perpendicular to the first section 3-5 and to the fourth section 5-6, and extends in a direction substantially parallel to the conductive surface 200 of the ground plane 106. With the upper portion of the second antenna element 104 having such substantially perpendicular sections, generally defined by points 4-5, 5-6, and 6-7, that extend from each other in a sequence, the antenna is thereby adapted to operate according to three different polarizations. The capability of the novel antenna to operate with three different polarizations with respect to the second antenna element 104 is a significant advantage of the particular embodiment of the present invention.

The second antenna element 104, according to one embodiment of the present invention, is dimensioned so as to achieve communication efficiency in the wireless communication frequency bands in the range of 800 MHz to 900 MHz, and in a particular example the frequency bands within that range as used by an iDEN two-way wireless communication device, manufactured and sold by Motorola, Inc.

FIG. 4 shows reference X, Y, Z axes. The radiation pattern of the second element 104 can generally be thought of as traveling along the X, Y, and Z axes, with no areas of complete nulls. In other words, the second antenna element radiates in a substantially omni-directional pattern.

Each of the sections of the second element 104 are generally supported by some supporting structure, which is not shown in FIGS. 1-4. For this reason, the dual-band antenna 100 is well suited for applications with display screens or imagers, around which some sections of the antenna element 104 can surround and find physical support.

Figure 5:
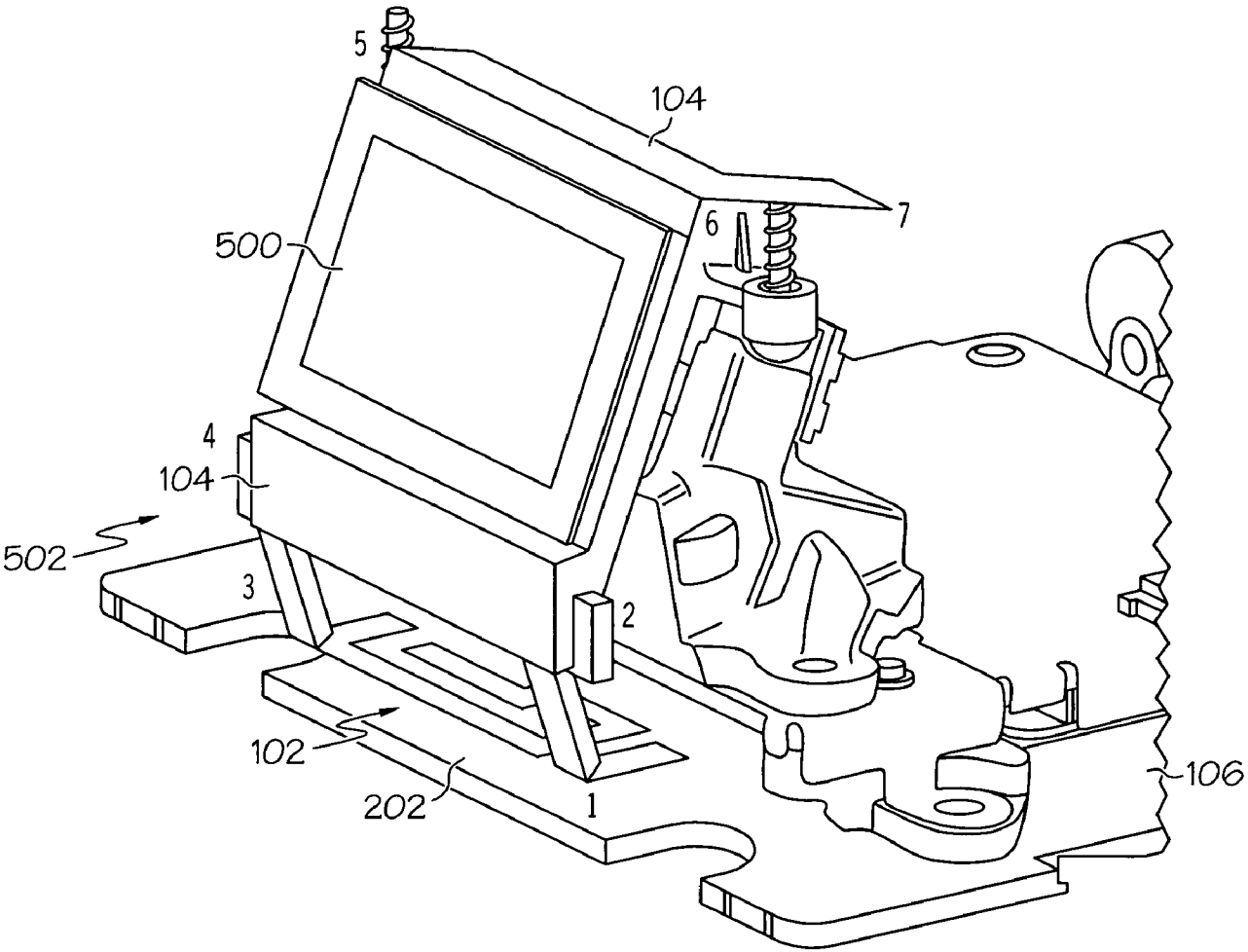
FIG. 5 is an elevated perspective view of the dual-element/dual-frequency band antenna of FIG. 1 on an imager frame, according to an embodiment of the present invention.

FIG. 5 shows an imager 500 supported by an imager frame 502. The imager 500 is a device that optically scans items, such as bar codes and is merely one example of a use for the present invention. Placed below the imager frame 502 and imager 500 is the first antenna element 102, which is shown as the shaded area on the substrate 202. The first antenna element 102 is fed from feed point 3, which is directly under a leg 506 of the imager frame 502.

Extending up from feed point 3 is the second antenna element 104, which is shown as the shaded areas. In the embodiment shown, the second antenna element 104 is integral with the frame 502 of the imager 500. The element 104 can be conductive material placed on the frame 502. For instance, if the frame is made of a dielectric material, the production process can be implemented by placing metal sheets, shims, foil, or any conductive coating on the dielectric parts. Alternatively, the frame 502 can be constructed from a conductive material and can radiate and receive RF energy itself. The segment-identifying numbers, 1-7, from FIG. 3 identify the same segments in the more detailed view of FIG. 5. As can be seen from the view of FIG. 5, the second antenna element 104 is not necessarily perfectly perpendicular to the ground plane 106 and not all sections of the element 104 are directly over each other. For the purposes of this discussion, the approximate physical relation of all sections of the second antenna element 104 in relation to the first antenna element 102 and the surface of the ground plane 106 is defined as "substantially" perpendicular.

The upper section, generally defined by points 4, 5, 6, 7, of the second antenna element 104 radiates and receives well in the iDEN wireless communication frequencies in the frequency band of 800 MHz to 900 MHz. The lower section, generally defined by points 4, 3, 2, 1, of the frame 502, which includes the lower half of the "h" shaped second antenna element 104, is used as a loop that is shared by GPS and iDEN wireless communications. Finally, as indicated in FIG. 5, the first antenna element 102 radiates and receives well in the GPS frequency 1,575.42 MHz.

Figure 6:
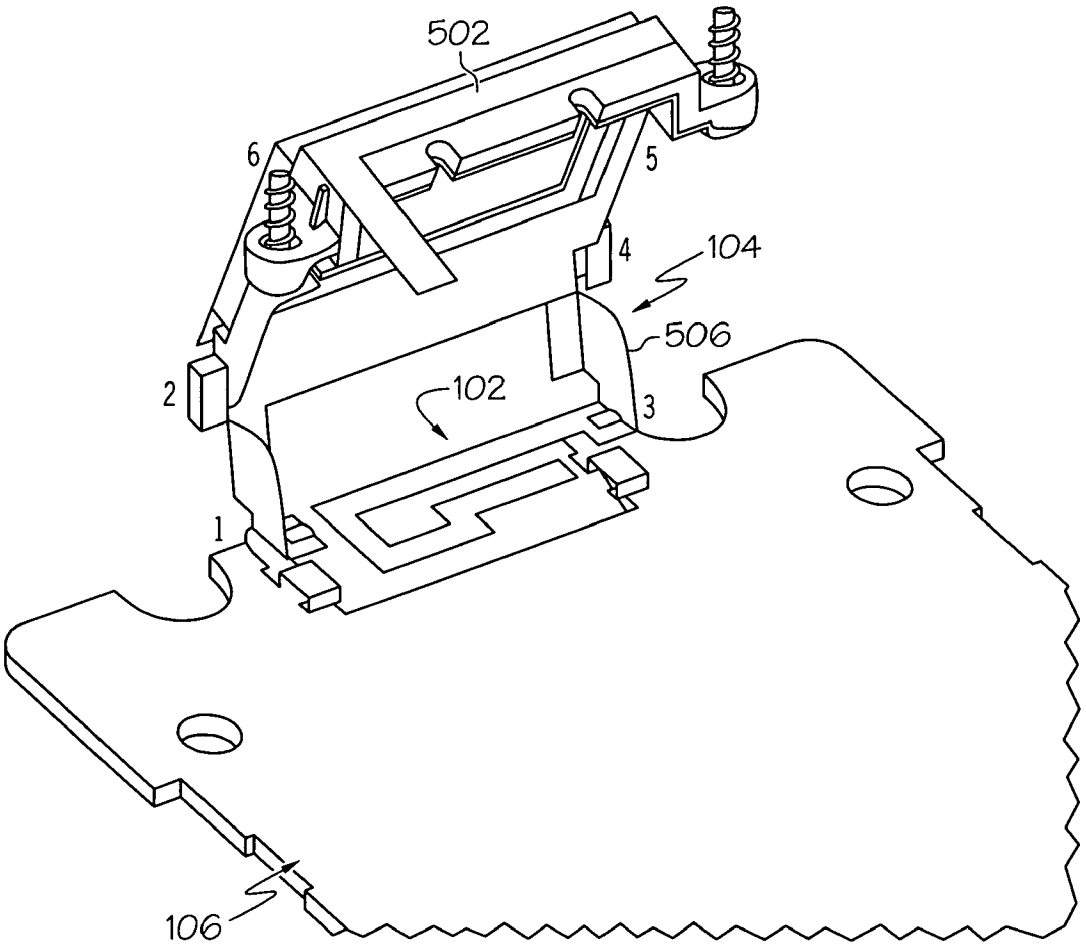
FIG. 6 is an elevated perspective view of the back side of the imager frame of FIG. 5, according to an embodiment of the present invention.

Turning now to FIG. 6, a backside of the imager frame 502 is shown, where it can be seen that integrated in the frame 502 is the second antenna element 104. The segment-identifying point numbers, 1 to 7, from FIG. 3, identify the same segments in the more detailed view of FIG. 6. From this view, it can be seen that the second antenna element 104 is also fed at point 3. Point 3 is in electrical communication with point 4 through a conductive pathway along the frame leg 506. Relatively large electrical pathways couple all of the same nodes as are shown in FIG. 3 and described above. The second antenna element 104 is electrically shorted to the ground plane 106 at point 1.

A specific example of an H-J antenna system, including dimensions for the various antenna element sections, the ground plane, and associated structures, will now be briefly discussed with reference to FIGS. 7 to 12.

Figure 7:
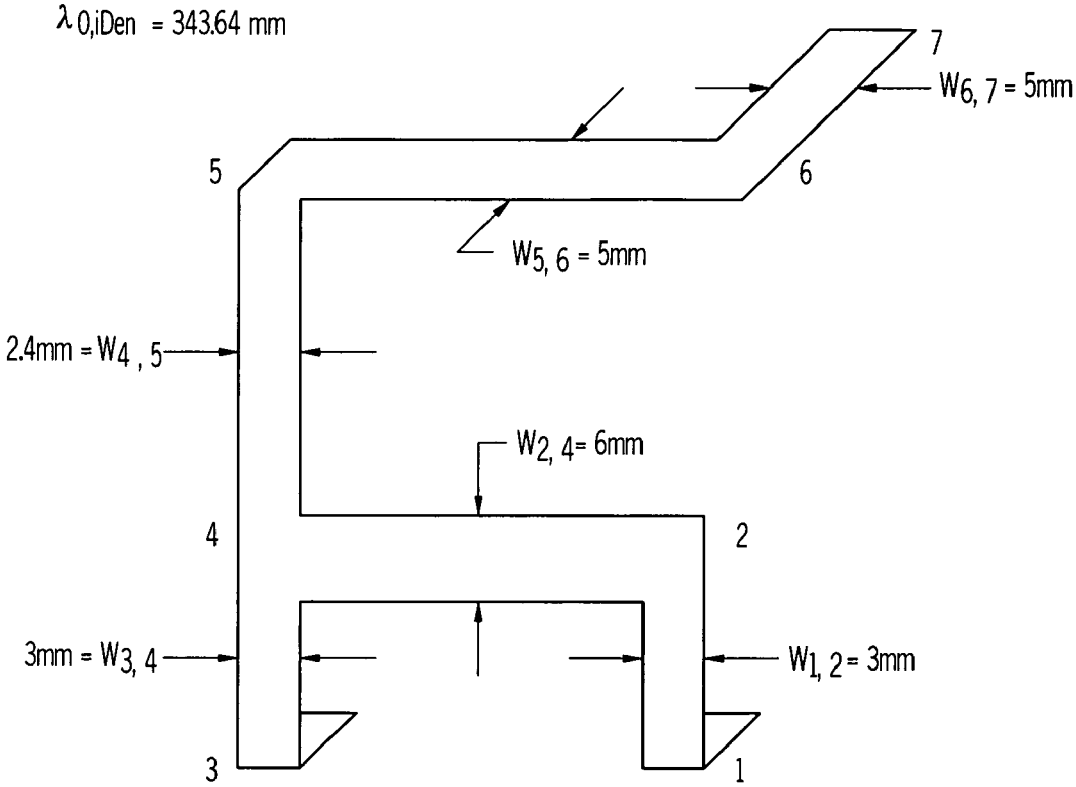
FIG. 7 is an illustration of an H-shaped element, showing dimensions, of an example of an antenna, according to an embodiment of the present invention.
Figures 8, 9:
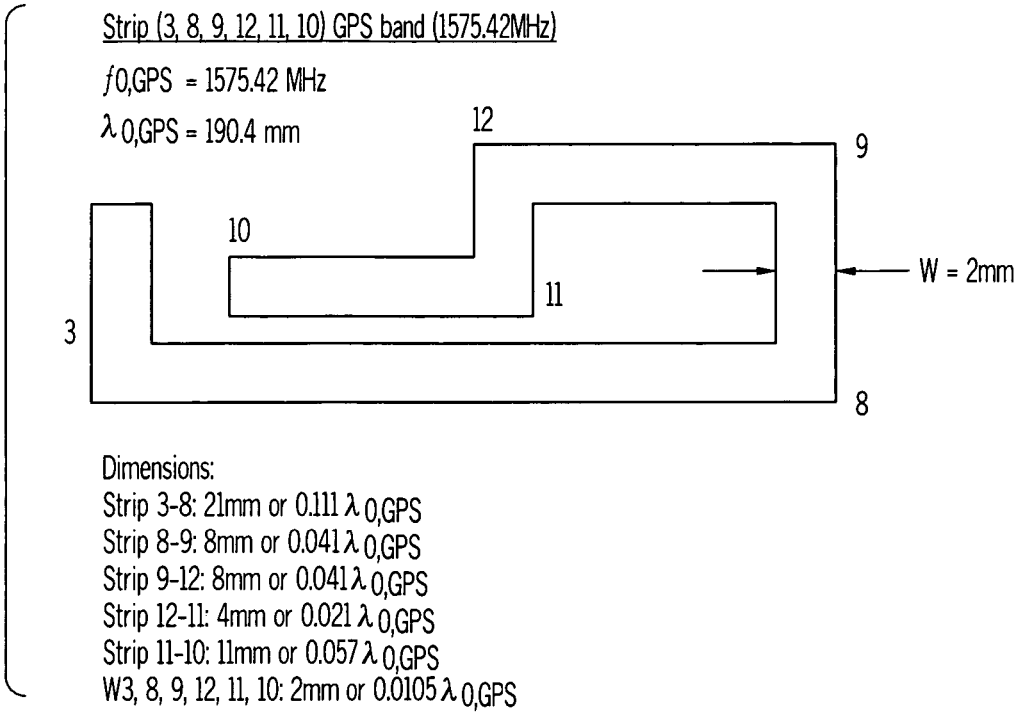
FIG. 8 is an illustration of a J-shaped element, showing dimensions, of the example of the antenna discussed with reference to FIG. 7.
FIG. 9 shows a formula and an example of dimensions for a bench-strip portion of the antenna, discussed with reference to FIGS. 7 and 8.

As can be seen in FIGS. 7 to 9, the dimensions of the second antenna element 104 are specified for a nominal operating frequency of 873.5 MHz, which is in the frequency range for iDEN wireless communications, and the dimensions of the first antenna element 102 are specified for a nominal operating frequency of 1575.42 MHz, which is in the frequency range for GPS wireless communication. The various strip sections are specified by length and width in FIGS. 7, 8, and 9, and these specifications will not be repeated here.

Figure 10:
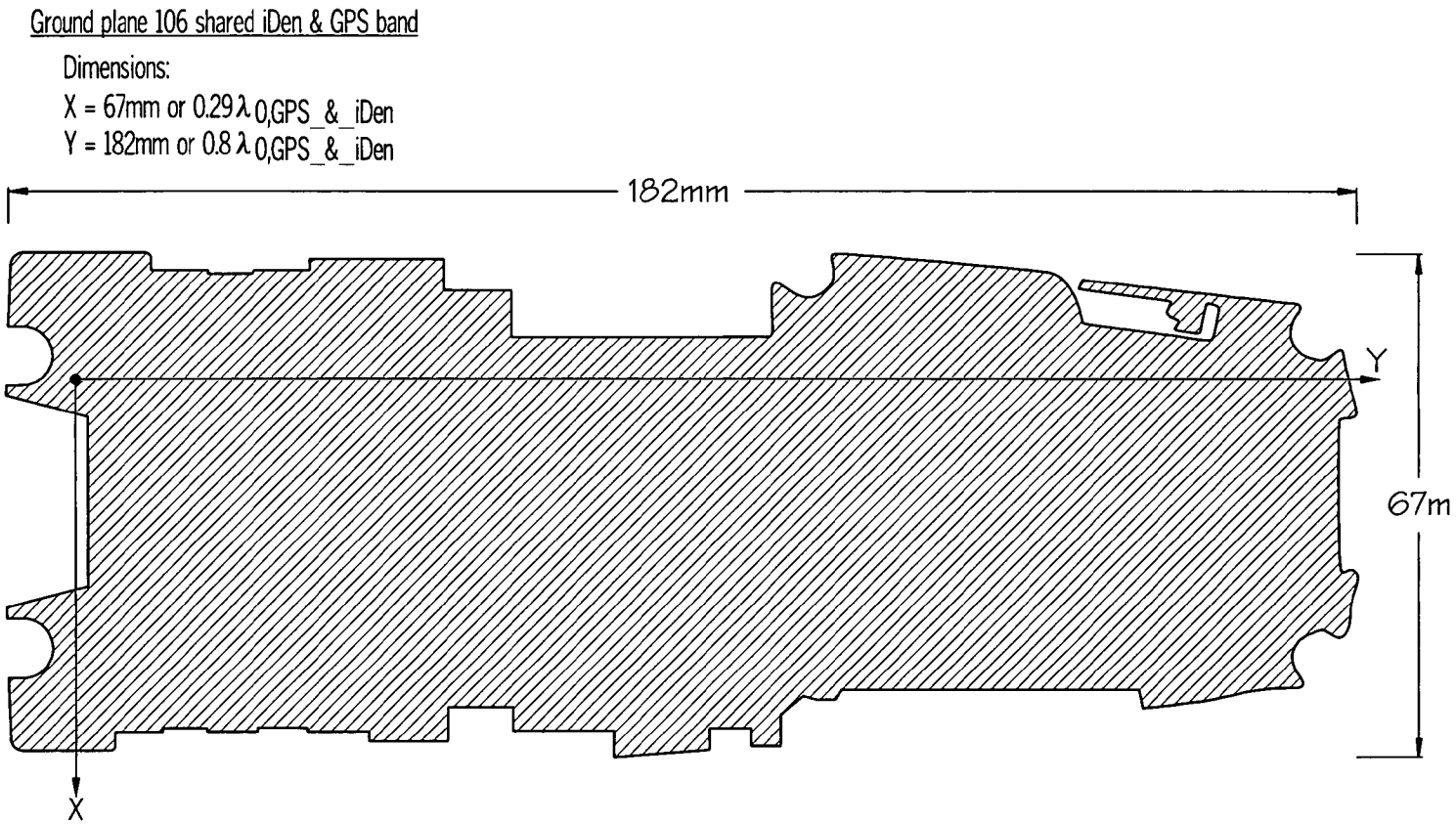
FIGS. 10 and 11 show a ground plane with dimensions for the example of the antenna discussed with reference to FIGS. 7 to 9.
Figure 11:
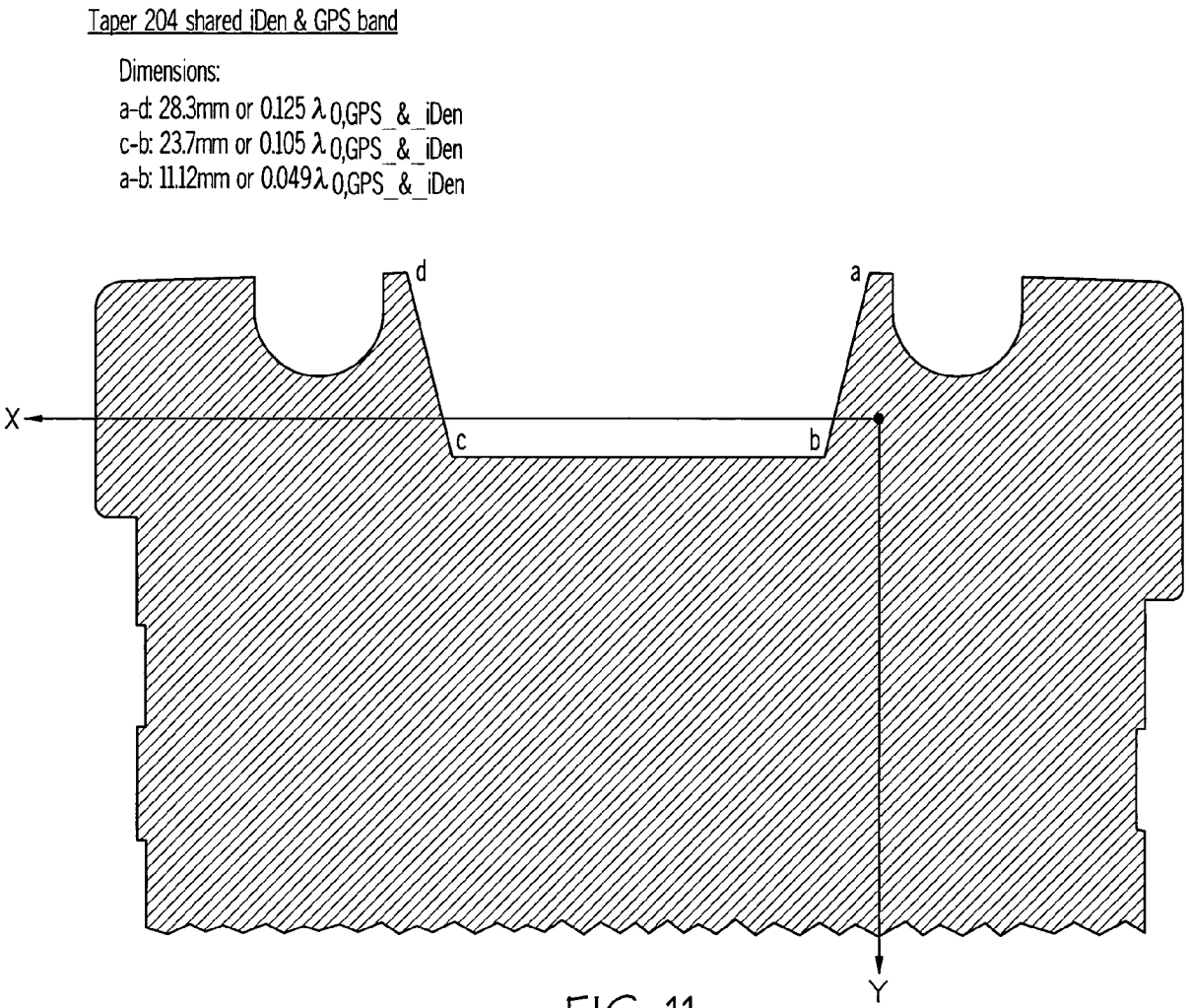

FIGS. 10 and 11 specify the dimensions of the ground plane 106 and the tapered channel 204, according to the example discussed with reference to FIGS. 7 to 9. The various dimensions for the ground plane 106 and the tapered channel 204 are specified by length and width in FIGS. 10 and 11, and these specifications will not be repeated here.

Figure 12A:
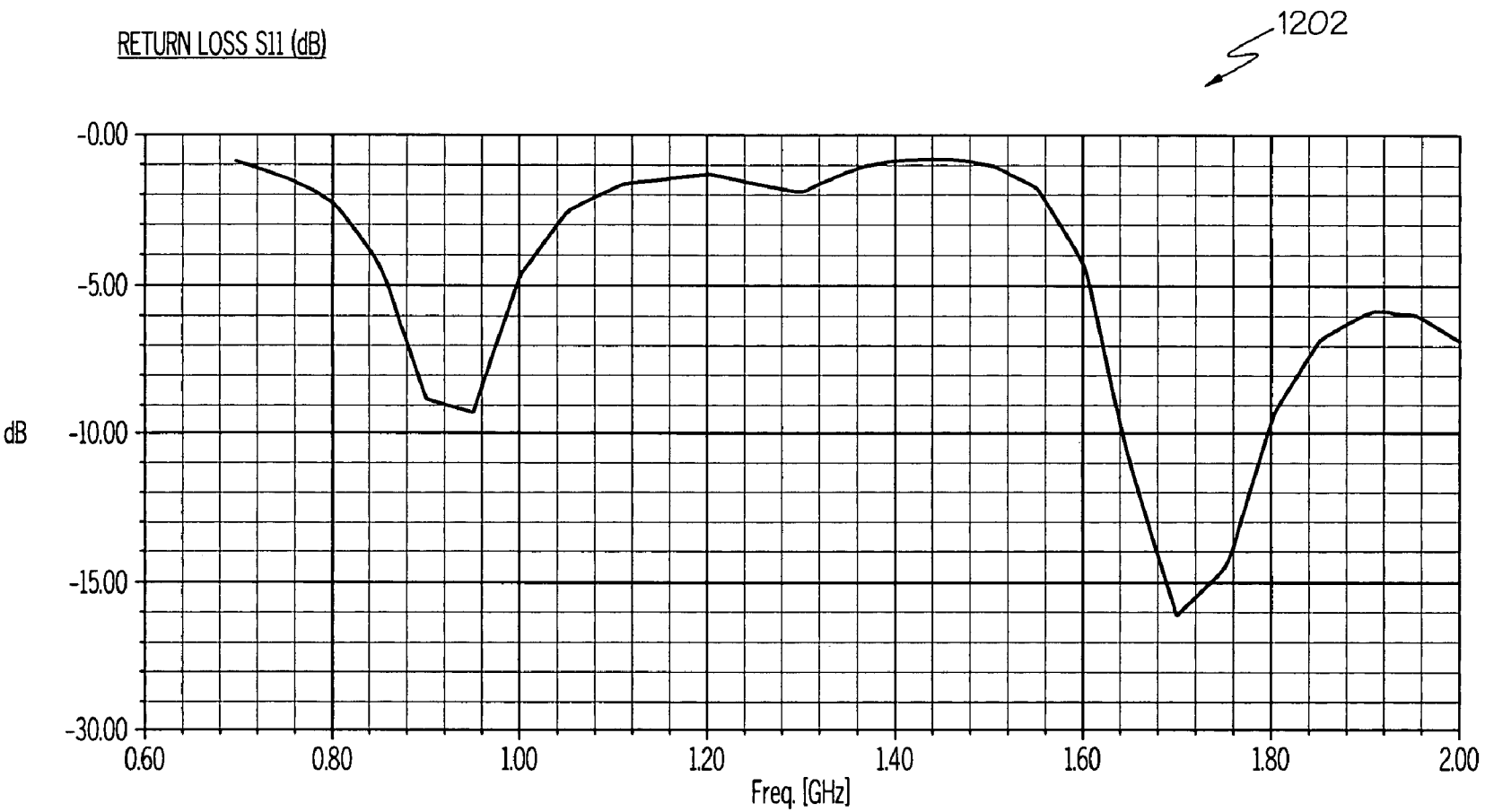
FIG. 12, represented by FIGS. 12A, 12B, 12C, and 12D, shows a chart illustrating a return loss plot for the example of the antenna discussed with reference to FIGS. 7 to 9, and also shows three tables illustrating efficiency of the antenna at frequencies of interest.

FIG. 12, represented by FIGS. 12A, 12B, 12C, and 12D, shows a plot 1202 of frequency in GHz, in the X-axis, vs. signal strength in dB, in the Y-axis, illustrating a simulation of return loss for an H-J antenna system, based on dimensions and construction parameters as have been shown and discussed above with reference to the example of FIGS. 7 to 11. Also shown are three tables 1204, 1206, and 1208, highlighting aspects of the antenna efficiency and gain relating to the frequency bands for iDEN wireless communications and GPS communications. The first table 1204 shows the average efficiency and average gain of the H-J antenna with respect to iDEN communication frequencies (around 850 MHz). The second and third tables 1206, 1208, show average efficiency and average gain of the H-J antenna with respect to GPS communication frequencies (around 1575 MHz). As can be appreciated by the discussion above, the H-J antenna system as specifically shown and described with reference to FIGS. 7 to 11, can operate in dual frequency bands that, in this particular example, are within the requirements for the two different types of wireless communications, i.e., iDEN wireless communications and GPS communications.

Conclusion

As should now be clear, embodiments of the present invention provide a dual-band antenna, e.g., an H-J antenna supporting wireless communications at two separate frequency bands, that provides performance analogous to that of a traditional external antenna, yet allows for a significant decrease in the volume/environment of the allocated antenna area. The unique design provides increased radiation resistance and, consequently, an increase in efficiency.

Non-Limiting Examples

Although specific embodiments of the invention have been disclosed, those having ordinary skill in the art will understand that changes can be made to the specific embodiments without departing from the spirit and scope of the invention. For example, in view of the discussion above, it should be understood that the H-J antenna system discussed above could be adjusted and matched to frequency bands for the antenna to operate with GSM wireless communications and DCS/PCS/UMTS wireless communications. As a second example, if the H-J antenna system discussed above with respect to GPS and iDEN wireless communications, which includes the H-J antenna, the ground plane, and associated structures, is scaled by ⅓ smaller dimensions X, Y, and Z, an antenna system can be obtained to operate at two ISM bands, IEEE 802.11a/b/g (e.g., 2.4 GHz for 802.11 b/g and 4.9 GHz for 802.11 a), and all antenna operational parameters, e.g., return loss, polarizations, radiation pattern, etc., will be maintained generally the same at the new ⅓ smaller dimensions. The scope of the invention is not to be restricted, therefore, to the specific embodiments, and it is intended that the appended claims cover any and all such applications, modifications, and embodiments within the scope of the present invention.

What is claimed is:

1. A dual-band antenna comprising:

a common antenna feedpoint;

a conductive ground plane having a first leg and a second leg, wherein the first leg and the second leg are electrically connected at a single end thereof, each leg having an opposing inside edge that defines a non-conductive channel in the conductive ground plane;

a first antenna element of the dual-band antenna having a general "J" shaped element extending away from the common antenna feedpoint at a distal end of the first leg of the conductive ground plane into the non-conductive channel, each portion of the "J" shaped element being substantially co-planar with one another and substantially coplanar with the conductive ground plane; and a second antenna element of the dual-band antenna having a general "h" shaped element extending away from the common antenna feedpoint at the distal end of the first leg of the conductive ground plane, each portion of the "h" shaped element being substantially co-planar with one another and disposed in a plane substantially perpendicular to the conductive ground plane, and wherein the second antenna element further comprises:

a first section extending from the distal end of the first leg of the conductive ground plane in a direction substantially perpendicular to the conductive ground plane;

a second section branching from the first section in an orientation substantially parallel to the conductive ground plane and in a direction toward the second leg, and offset from the ground plane by a first distance; and a third section oriented substantially parallel with the first section and having a first end in direct electrical contact with the second section and having a second end in direct electrical contact with a distal end of the second leg of the conductive ground plane;

a fourth section branching from a distal end of the first section in a direction toward the second leg of the conductive ground plane and in an orientation substantially parallel to the second section of the second antenna element; and a fifth section branching from an end of the fourth section, the fifth section oriented substantially perpendicular to the first section and the fourth section and substantially parallel to the conductive ground plane.

2. The dual-band antenna according to claim 1, wherein the first antenna element comprises:

a first section extending from the common antenna feedpoint and the distal end of the first leg of the conductive ground plane into the non-conductive channel in a direction toward the second leg of the conductive ground plane;

a second section directly electrically connected to the first section, the second section oriented substantially perpendicular to the first section and extending in a direction toward the conductive ground plane; and a third section directly electrically connected to the second section, the third section oriented substantially parallel to the first section and extending in a direction toward the first leg of the conductive ground plane and the common antenna feedpoint.

3. The dual-band antenna according to claim 2, wherein the second and third sections of the first antenna element are generally contained within the non-conductive channel in the conductive ground plane.

4. The dual-band antenna according to claim 1, wherein the first, second, and fourth sections of the second antenna element at least partially define an imager window frame.

5. The dual-band antenna according to claim 1, wherein the first antenna element and the second antenna are formed by a pathway of stripline conductive material.

6. A dual-band antenna comprising:

a conductive ground plane having a first leg and a second leg, wherein the first leg and the second leg are electrically connected at a single end thereof, each leg having an opposing inside edge that defines a non-conductive channel in the conductive ground plane;

a first antenna element extending from a distal end of the first leg of the conductive ground plane into the non-conductive channel and having an orientation substantially coplanar with the conductive ground plane; and a second antenna element including:

a first section extending from the distal end of the first leg of the conductive ground plane in a direction substantially perpendicular to the conductive ground plane;

a second section branching from the first section in an orientation substantially parallel to the conductive ground plane and in a direction toward the second leg, the second section in direct electrical contact with a distal end of the second leg of the conductive ground plane;

a third section branching from a distal end of the first section in a direction toward the second leg of the conductive ground plane and in an orientation substantially parallel to the second section of the second antenna element; and a fourth section branching from an end of the third section, oriented substantially perpendicular to the first section and the third section and oriented substantially parallel to the conductive ground plane.

7. The dual-band antenna of claim 6, wherein the second antenna element includes three sections oriented substantially perpendicular to each other and adapted to operating the antenna with three different polarizations.

8. The dual-band antenna of claim 6, wherein the first antenna element generally has a "J" shape.

9. The dual-band antenna of claim 6, wherein the second antenna element generally has an "h" shape.

10. The dual-band antenna of claim 6, wherein the first antenna element and the second antenna element share a common feed point, and the first and second antenna elements being oriented substantially perpendicular to each other.

11. The dual-band antenna of claim 6, wherein the first antenna element and the second antenna element are adapted to efficiently operate the antenna at approximately 1575 MHz and approximately 850 MHz, respectively.

* * * * *

UNITED STATES PATENT AND TRADEMARK OFFICE

CERTIFICATE OF CORRECTION

PATENT NO. : 8,199,065 B2
APPLICATION NO. : 11/965780
DATED : June 12, 2012
INVENTOR(S) : Shachar et al.

It is certified that error appears in the above-identified patent and that said Letters Patent is hereby corrected as shown below:

In Column 1, Line 29, delete “tack” and insert -- track --, therefor.

Signed and Sealed this
Fifteenth Day of January, 2013

David J. Kappos

David J. Kappos
*Director of the United States Patent and Trademark Office*